US008939058B1

(12) United States Patent
Ecalono

(10) Patent No.: US 8,939,058 B1
(45) Date of Patent: Jan. 27, 2015

(54) PORTABLE BALLISTIC RESISTANT SHIELD

(76) Inventor: Chad Jason Ecalono, Gilbert, AZ (US)

( * ) Notice: Subject to any disclaimer, the term of this patent is extended or adjusted under 35 U.S.C. 154(b) by 137 days.

(21) Appl. No.: 13/595,542

(22) Filed: Aug. 27, 2012

Related U.S. Application Data

(60) Provisional application No. 61/527,399, filed on Aug. 25, 2011.

(51) Int. Cl.
*F41H 5/08* (2006.01)
*F41H 1/00* (2006.01)
*F41H 1/02* (2006.01)

(52) U.S. Cl.
CPC .. *F41H 1/00* (2013.01); *F41H 1/02* (2013.01); *F41H 5/08* (2013.01)
USPC ..... 89/36.05

(58) Field of Classification Search
CPC ..... F41H 5/08; F41H 1/02
USPC ..... 89/36.05, 926, 927, 928
See application file for complete search history.

(56) References Cited

U.S. PATENT DOCUMENTS

| | | | | |
|---|---|---|---|---|
| 2,306,708 | A * | 12/1942 | Mendel | 42/106 |
| 2,904,792 | A * | 9/1959 | Hugh | 2/16 |
| 5,044,011 | A | 9/1991 | Henderson | |
| 5,241,703 | A * | 9/1993 | Roberts et al. | 2/2.5 |
| 5,797,140 | A | 8/1998 | Davis et al. | |
| 6,886,446 | B1 | 5/2005 | Baker | |
| 6,990,887 | B1 | 1/2006 | O'Donnell | |
| 7,221,552 | B1 | 5/2007 | Brown | |
| D554,806 | S | 11/2007 | Le Carpentier | |
| 7,571,493 | B1 | 8/2009 | Purvis et al. | |
| 2011/0167529 | A1 * | 7/2011 | Anderson et al. | 2/2.5 |
| 2012/0180636 | A1 * | 7/2012 | Seuk | 89/36.07 |

FOREIGN PATENT DOCUMENTS

EP 2543953 * 1/2013

OTHER PUBLICATIONS

ShannonThomas.org, Humble Scribe of the Heretic's Quest, Gear: Shield Gauntlet, http://shannonthomas.org/gear-shield-gauntlet, pp. 1-2, Jul. 11, 2011.

* cited by examiner

*Primary Examiner* — Stephen M Johnson
(74) *Attorney, Agent, or Firm* — Schmeiser, Olsen & Watts LLP

(57) ABSTRACT

A portable ballistic resistant shield device is provided. The device includes an attachment portion for coupling the device to an arm of a user, wherein the user has full function of a hand of the arm the device is coupled to. The device may also include a shield member operatively coupled to the attachment portion, a securing mechanism operatively coupled between the attachment portion and the shield member and an activation switch coupled to the attachment portion and operatively connected to the securing mechanism. The shield member is moveable between a stored position and a deployed position, wherein the securing mechanism retains the shield member in the stored position and releases the shield member to automatically deploy in response to activating the activation switch.

19 Claims, 5 Drawing Sheets

PORTABLE BALLISTIC RESISTANT SHIELD

CROSS REFERENCE TO RELATED APPLICATION

This application claims priority to U.S. Provisional Patent Application to Ecalono entitled "PORTABLE BALLISTIC RESISTANT SHIELD," Ser. No. 61/527,399, filed Aug. 25, 2011, the disclosure of which is hereby incorporated entirely herein by reference.

BACKGROUND OF THE INVENTION

1. Technical Field

This invention relates generally to a ballistic resistant shield and more particularly to a portable ballistic resistant shield that is carried on an arm of a user.

2. State of the Art

There are various types of public servants that place themselves in dangerous positions in order to protect and provide peace to communities. These public servants may include, but are not limited to police officers, sheriff's deputies, highway patrol, border patrol, military personnel, private security and the like (collectively "officers"). These men and women are at times faced with receiving direct and unexpected gun fire from assailants and criminals. In these instances, they are left to themselves to avoid being struck by such gunfire, and often times, they are not able to.

In attempts to prevent such a thing from happening, certain devices have been created. For example, ballistic vests are now virtually part of the uniform and serve to protect the user's chest and torso areas. Some ballistic shields have been created where a user can carry a shield to protect him. Also ballistic helmets have also been created so that a user can protect her head.

While these devices are helpful in protecting an officer, each has its limitations. A ballistic vest is effective at protecting an officers chest and torso area, but still leaves the head and face exposed and further does not provide a psychological advantage to the officer. Ballistic shields are bulky and make it difficult for an officer to do anything other than hold the shield, and in most cases, the shield requires at least one hand to hold the shield and limits the officer's ability to defend him by limiting the use of one hand. Ballistic helmets are limited to protection of just the head.

Accordingly, there is a need for an improved ballistic resistant shield that provides portability, better protection, a psychological advantage and the ability to defend oneself with both hands.

DISCLOSURE OF THE INVENTION

The present invention relates to a portable ballistic resistant shield device that is worn on an arm of an officer and provides protection from small arms, such as hand guns. Generally, the portable ballistic resistant shield is moveable between a stored position and a deployed position.

An embodiment of the invention includes a portable ballistic resistant shield device comprising an attachment portion for coupling the device to an arm of a user, wherein the user has full function of a hand of the arm the device is coupled to. The device may also comprise a shield member operatively coupled to the attachment portion, a securing mechanism operatively coupled between the attachment portion and the shield member and an activation switch coupled to the attachment portion and operatively connected to the securing mechanism.

According to embodiments, the shield member may be a spring loaded section that is collapsible to a stored position, wherein the securing mechanism retains the shield member in the stored position. In these embodiments, the activation switch may be operated to actuate the securing mechanism, wherein actuation of the securing mechanism releases the shield members, wherein the springs of the spring loaded shield member function to automatically extend the shield member into the deployed position. In the deployed position, some embodiments have a shield member that extends from one side of the arm, other embodiments from the other side of the arm and further still some embodiments the shield member extends from both sides of the arm.

The shield may then be used by the wearer as a protection from small arms. The hand of the wearer, because of the glove-like configuration of the device is free for performing close combat defensive and offensive maneuvers that include, but are not limited to grasping, striking and the like.

In some embodiments, the shield member may be panels of material that are attached to adjacent panels in a fan-like interlocking tongue and groove fashion.

Some embodiments include a method of using a portable ballistic resistant shield device. The method includes the steps of coupling a portable ballistic resistant device to a forearm of a wearer; retaining a shield member of the device in a stored position; activating the activation switch of the device; actuating the securing mechanism in response to activating the activation switch; automatically moving the shield member from the stored position to a deployed position; and protecting the wearer from small arms fire.

Another aspect of the present invention includes a portable ballistic shield device, the device comprising: an attachment portion for coupling the device to an arm of a user, wherein the attachment portion is configured to couple to the arm without restricting the function of the hand and fingers of the arm to which the device is coupled; a shield member operatively coupled to the attachment portion, the shield member being configured to transition between a stored position and a deployed position; a securing mechanism operatively coupled to the attachment portion, the securing mechanism being configured to maintain the shield member in the stored position; and an activation switch coupled to the attachment portion and operatively connected to the securing mechanism, wherein operation of the activation switch transitions the shield member from the stored position to the deployed position.

Another aspect of the present invention includes a biasing member coupled to the attachment portion, wherein the biasing member biases the shield member in the deployed position, such that under the condition the shield member is in the stored position and the activation switch is operated the shield member immediately transitions to the deployed position and remains in the deployed position.

Another aspect of the present invention includes wherein the activation switch is configured on the device to be operated by one of the arm, hand, fingers of the arm to which the device is coupled.

Another aspect of the present invention includes wherein the activation switch is configured in the palm of the hand of the arm to which the device is coupled.

Another aspect of the present invention includes wherein the shield member is configured to occupy a larger surface area in the deployed position than in the stored position.

Another aspect of the present invention includes wherein the shield member is configured to pivot about a pivot point on the attachment portion between the stored and deployed positions.

Another aspect of the present invention includes wherein the shield member is configured to telescope with respect to the attachment portion between the stored and deployed positions.

Another aspect of the present invention includes wherein the shield member further comprises a shield arm and a plurality of shield parts, wherein neighboring shield parts are operatively coupled to one another, an outermost shield part is coupled to the shield arm, and the shield member is deployed as the shield arm moves with respect to the attachment portion.

Another aspect of the present invention includes wherein the attachment portion and the shield member are comprised of material that satisfies the ballistic requirements of Classification Type II of the National Institute of Justice.

Another aspect of the present invention includes a portable ballistic shield device, the device comprising: an attachment portion for coupling the device to an arm of a user, wherein the attachment portion is configured to couple to the arm without restricting the function of the hand and fingers of the arm to which the device is coupled; a plurality of shield arms operatively coupled to the attachment portion, each of the shield arms being configured to transition between a stored position and a deployed position; a securing mechanism operatively coupled to the attachment portion, the securing mechanism being configured to maintain the plurality of shield arms in the stored position; and an activation switch operatively connected to the securing mechanism, wherein operation of the activation switch transitions the plurality of shield arms from the stored position to the deployed position.

Another aspect of the present invention includes the invention further comprising: a shield material coupled between the plurality of shield arms, the shield material being configured to satisfy the ballistic requirements of Classification Type II of the National Institute of Justice and being configured to bend under the condition that the plurality of shield arms transition between the stored and deployed positions.

Another aspect of the present invention includes wherein the shield material is configured to occupy a larger surface area in the deployed position than in the stored position.

Another aspect of the present invention includes the invention further comprising: a plurality of pivots coupled to the attachment portion, each pivot being operatively coupled to a corresponding shield arm of the plurality of shield arms.

Another aspect of the present invention includes the invention further comprising: an activation biasing member operatively coupled between the securing mechanism and the activation switch; and a shield arm biasing member operatively coupled between the pivot and the corresponding shield arm, wherein the activation biasing member is configured to bias the plurality of shield arms in the stored position, and wherein each of the shield arm biasing members is configured to bias the shield arms in the deployed position.

Another aspect of the present invention includes the plurality of shield arms further comprising: a pair of first shield arms; and a pair of second shield arms, wherein under the condition that the shield arms are in the stored position the pair of first shield arms function to maintain the pair of second shield arms in the stored position, and wherein under the condition that the activation switch is operated the pair of first shield arms transition from the stored position to the deployed position and release the pair of second shield arms to transition from the stored position to the deployed position.

Another aspect of the present invention includes wherein the securing member is configured to maintain the pair of first shield arms in the stored position until the activation switch is operated.

Another aspect of the present invention includes the present invention further comprising: a first shield material operatively coupled between one of the first shield arms and one of the second shield arms; and a second shield material operatively coupled between a second of the first shield arms and a second of the second shield arms, wherein the first shield material and the second shield material are configured to satisfy the ballistic requirements of Classification Type II of the National Institute of Justice and are configured to each acquire a quadrilateral shape in the deployed position.

Another aspect of the present invention includes a method of using a portable ballistic device, the method comprising: coupling a portable ballistic-resistant device to a forearm of a wearer; retaining a shield member of the device in a stored position on the device; operating an activation switch on the device; automatically transitioning the shield member from the stored position to a deployed position in response to operating the activation switch, wherein in the deployed position the shield member occupies a larger surface area than the shield member occupies in the stored position; and using the deployed shield member to protect the wearer from small arms fire, from knife attacks, and/or from hand-to-hand combat.

Another aspect of the present invention includes the method further comprising: using the hand and fingers of the arm carrying the device independently of the device; using the shield member in the deployed position as a weapon; and manually moving the shield member from the deployed position to the stored position.

Another aspect of the present invention includes the method further comprising: manually moving a portion of the shield member from the deployed position to the stored position while leaving another portion of the shield member in the deployed position.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

A detailed description of the hereinafter described embodiments of the disclosed apparatus and method are presented herein by way of exemplification and not limitation with reference to the Figures listed above. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

As discussed above, embodiments of the present invention relate to portable ballistic resistant shield device that is worn on an arm of an officer and provides protection from small arms, such as hand guns. Generally, the portable ballistic resistant shield is moveable between a stored position and a deployed position.

Figure 1:
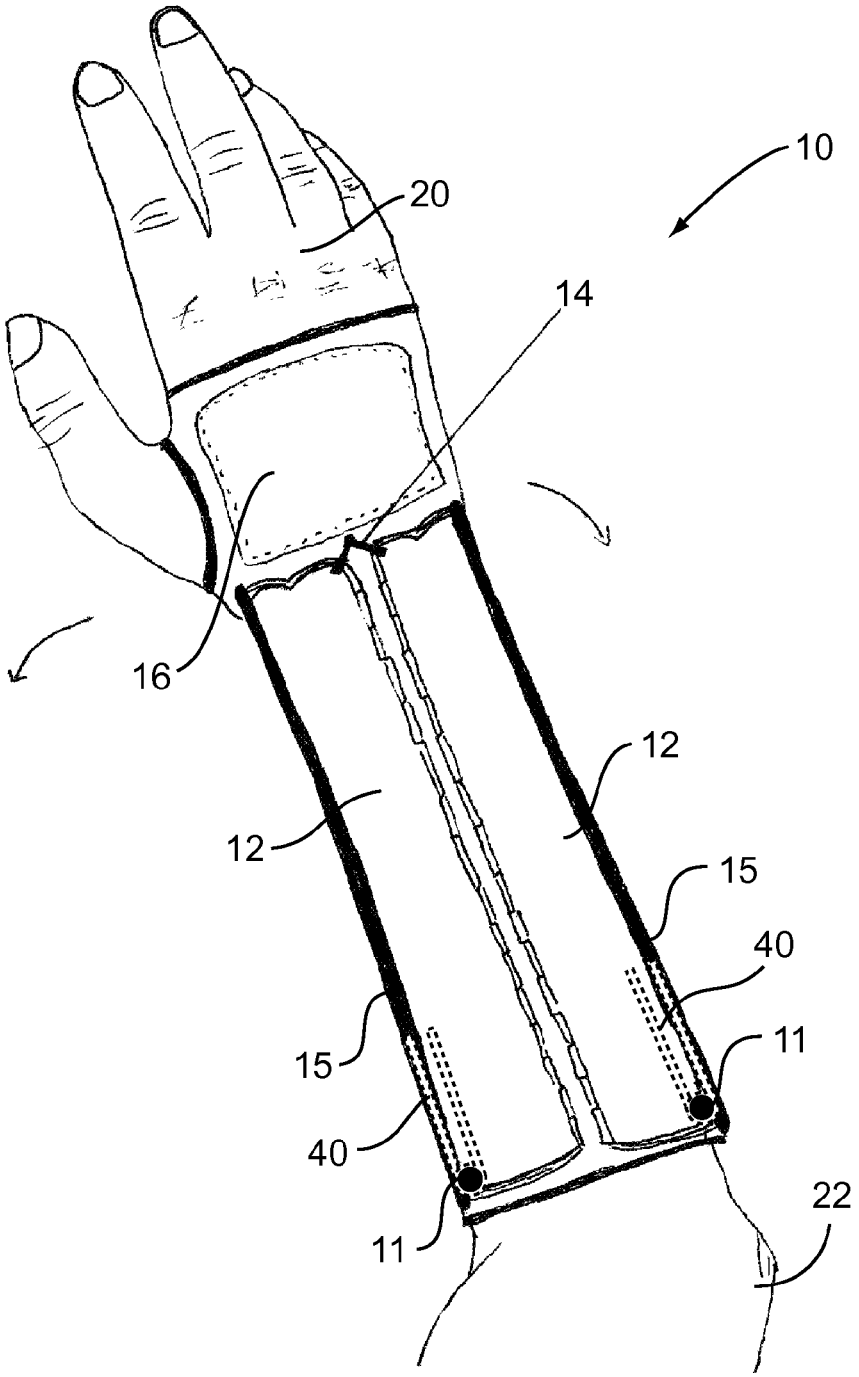
FIG. 1 is a perspective view of a portable ballistic resistant shield with a shield member in a stored position in accordance with the present disclosure.
Figure 2:
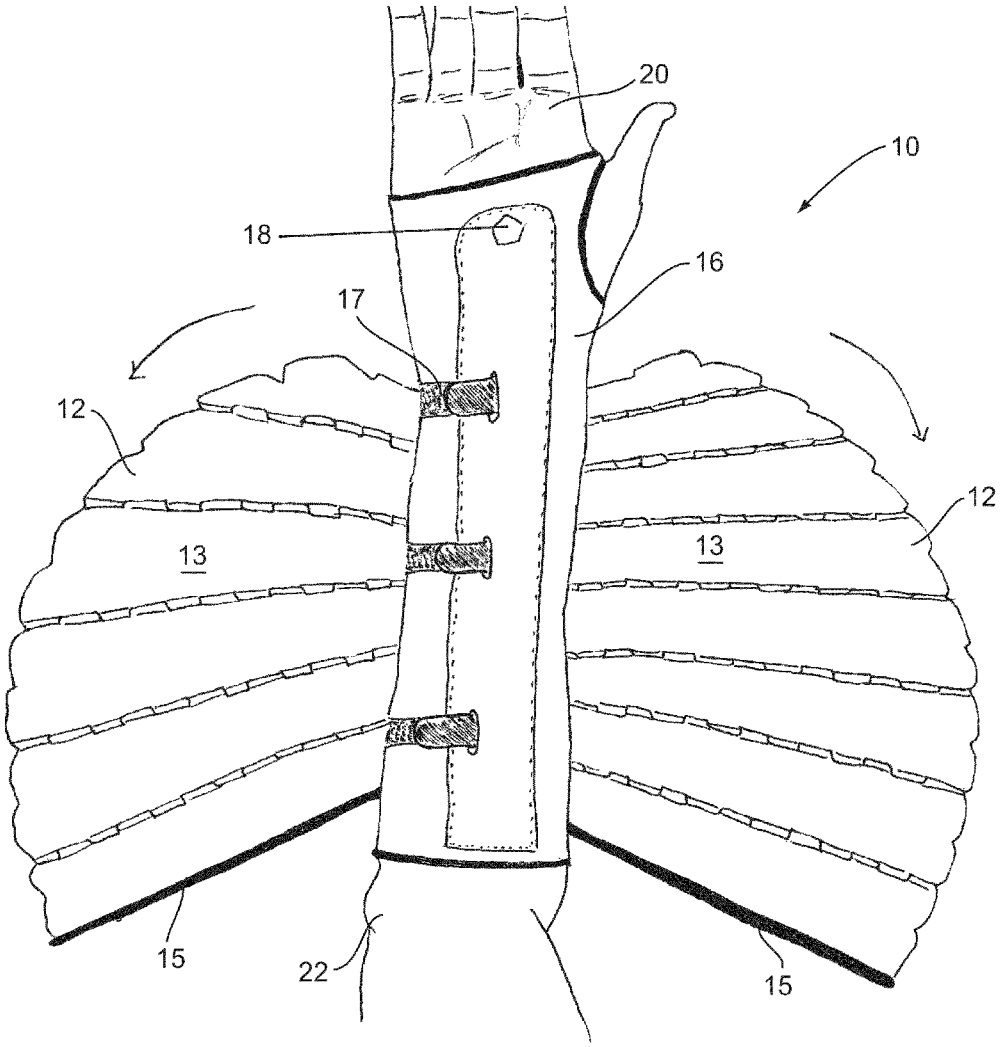
FIG. 2 is a perspective view of a portable ballistic resistant shield with a shield member in a deployed position in accordance with the present disclosure.

Referring to the drawings, FIGS. 1 and 2 depict a portable ballistic resistant shield device 10 in accordance with particular embodiments. The device 10 includes shield member 12, securing mechanism 14, attachment portion 16 and activation switch 18. The attachment portion 16 is configured to secure to an area of an arm that extends from the back of a wrist of a hand 20 to a crook of a forearm/elbow 22 of a user. The shield member 12 is operatively coupled to the attachment portion 16. The securing mechanism 14 is operatively coupled between the attachment portion 16 and the shield member 12. The activation switch 18 is coupled to the attachment portion 16 and operatively connected to the securing mechanism 14.

According to embodiments of the present invention, the shield member 12 may be a spring loaded shield member that is configured to transition between a stored position and a deployed position, the shield member 12 being collapsible from the deployed position to the stored position, wherein the securing mechanism 14 retains the shield member 12 in the stored position. In these embodiments, the activation switch 18 may be operated to actuate the securing mechanism 14, wherein actuation of the securing mechanism 14 releases the shield member 12 from the stored position and permits the shield member 12 to transition to the deployed position by operation of biasing members 40. For example, in response to the actuation of the securing mechanism 14, the biasing members 40 are springs of the spring loaded shield member 12 function to automatically and mechanically extend the shield member 12 into the deployed position. In the deployed position, some embodiments have a shield member 12 that extends from one side of the arm, other embodiments from the other side of the arm and further still some embodiments the shield member 12 includes two portions, each portion extending from both sides of the arm as shown in FIG. 2.

According to embodiments of the present invention, the shield member 12 may be formed of a material that is resistant to small arms ballistics. The National Institute of Justice ("NIJ") establishes the minimum performance requirements and test methods for the ballistic resistance of personal body armor. Further a more comprehensive report on ballistic body armor classifications, details requirements (e.g., acceptance criteria, workmanship and armor backing material), and test methods (e.g., velocity measurement equipment, wet conditioning and test preparation) are provided in the publication of the NIJ entitled *Ballistic Resistance of Body Armor NIJ Standard*-0101.06., as well as any update to this document (collectively "Body Armor Standard Publications"). The disclosure the Body Armor Standard Publications are incorporated entirely herein by reference.

The Body Armor Standard Publications provides classification types. It is contemplated that the shield member 12 may be formed of material that meets the NIJ Classification Type IIIA being resistant to .357 SIG and .44 Magnum bullets. While it is contemplated that the material of the shield member 12 by a Type IIIA, any classification of material may be used as indicated in the Body Armor Standard Publications. For example, the shield member 12 may be formed of material that meets the NIJ Classification Type II (9 mm and .40 S&W bullets), IIA (9 mm and .357 Magnum bullets), III (.357 SIG and .44 Magnum bullets), IIIA (rifle bullets), or IV (armor piercing rifle bullets). The shield member 12 may be composed of a transparent material. Further, the material may also be formed of other available ballistic resistant composites that could provide a lighter total weight so as to not encumber the wearer.

The shield member 12 may be formed of interlocking fan-like members 13 that are attached together in a fan-like interlocking tongue and groove fashion, and then affixed to the attachment portion 16. In some embodiments, two separate shield members include two separate shield arms 15, which are held in the stored position by the securing mechanism 14 and then released together into the deployed position in response to activating the activation switch 18. The shield arms 15 may be constructed from a lightweight metal or polymer material according to some embodiments. The shield arms 15 as well as the interlocking tongue and groove configuration between fan-like members 13 may be configured to provide structural support to and between each of the fan-like members 13, such that the structural support provides rigidity and strength to each of the fan-like members 13 and assists the fan-like members 13 in resisting or stopping ballistic impact on any one of the fan-like members 13. For example, in the case of ballistic impact on any one of the fan-like members 13, the tongue and groove configuration between the neighboring fan-like members 13 and between the remaining fan-like members 13 of the shield member 12, as well as the structural rigidity provided by the shield arms 15, prevent the impacted fan-like member 13 from bending, breaking, or otherwise giving way to the ballistic impact. In other words, the structural configuration between each of the fan-like members 13, as well as the rigidity provided by the shield arms 15 to the fan-like members 13, allow the shield member 12 to absorb the ballistic impact and maintain the structural integrity of the shield member 12 despite the impact.

While a tongue and groove configuration is described above, other types of connections of the fan-like members 13 may be utilized, such as, without limitation, ballistic material coupled to a middle portion of each fan-like member 13, wherein the ballistic material is of a size and shape to expand the fan-like members with each fan-like member 13 overlapping immediately adjacent fan-like members 13.

It will be understood that in embodiments where two shield members 12 are utilized, that each shield member 12 operates independently. While the initial deployment of the shield members 12 may occur simultaneously, the wearer has the option to close one level of the device to permit the wearer to perform shooting from a prone platform. In other words, once the shield members 12 have initially been deployed, the wearer can assess whether it would be advantageous to close and store one of the two shield members 12, and thereafter close and store one of the two shield members 12.

Further, the shield member 12 may be a spring loaded shield member 12. In embodiments wherein the shield member 12 includes fan-like members 13, the shield member may include a pivot point 11, where about the fan-like members 13 rotate. The spring may be a torsion spring operatively coupled to the shield arm 15 at the pivot point 11. The torsion spring is preloaded, such that the spring will move the shield arm 15 to a deployed position when the securing mechanism 14 is released, accordingly, it requires force to move the shield member 12 from the deployed position to the stored position. Upon operation of the activation switch 18, the spring may be configured to transition the shield arm 15, and thus the shield member 12 operatively coupled thereto, from the stored position to the deployed position in an immediate and almost instantaneous fashion, such that the transition from the stored position to the deployed position is rapid, violent, and prompt. In the alternative, upon operation of the activation switch 18, the spring may be configured to transition the shield arm 15, and thus the shield member 12, from the stored position to the deployed position in a slow and steady fashion, such that the transition from the closed position to the deployed position is smooth, deliberate, and relaxed. While it has been described that a torsion spring is used, it is understood that other types of springs may be used or other types of compliant mechanisms may be used to automatically move the shield member 12 from the stored to the deployed position.

Figure 3A:
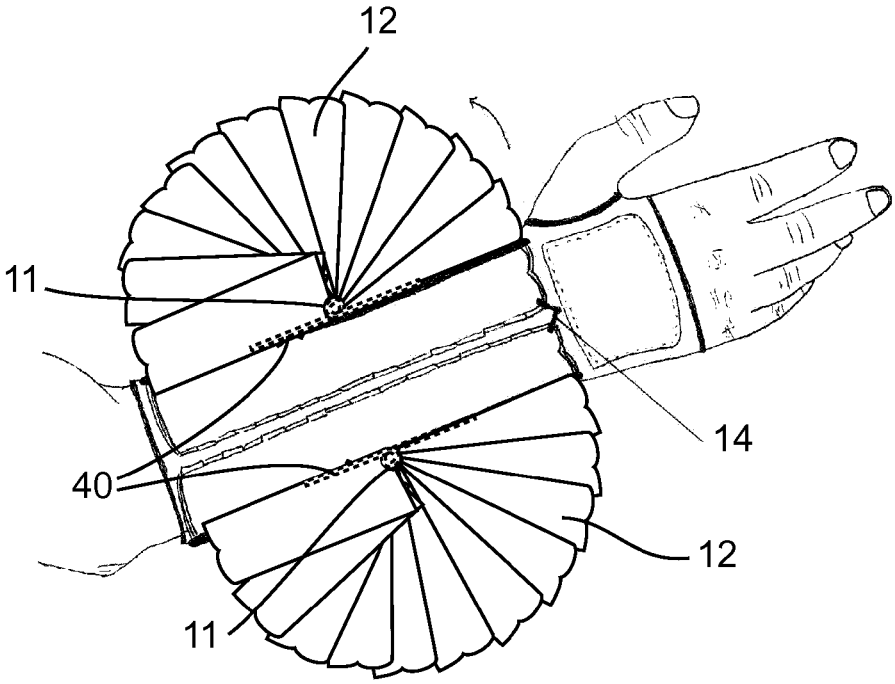
FIGS. 3*a*-3*b* are front views of various configurations of a shield member in a deployed position in accordance with the present disclosure.
Figure 3B:
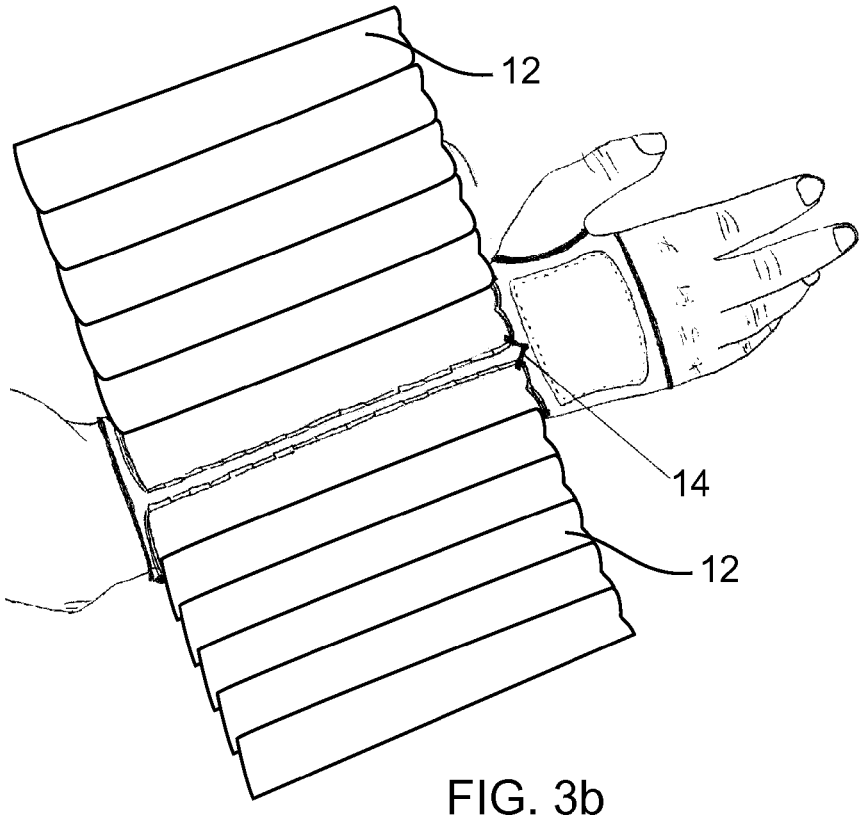

Referring further to the drawings, FIG. 3 depicts various configurations of the shield member 12 with fan-like members 13. For example, the pivot point 11 may be configured on one side of the shield member 12, as shown in FIG. 1 or the pivot point 11 may be configured proximate the middle of the shield member 12 wherein the fan-like members 13 rotate approximately 180 degrees in the deployed position as shown in FIG. 3*a*. Alternatively, the fan-like members 13 may be provided as members that extend outwardly in a direction orthogonal to the direction defined as the length of the device on the forearm of the wearer, as shown in FIG. 3*b*. For example, telescoping shield arms 15 may function to extend the fan-like members 13 outwardly from the forearm of the wearer in the direction orthogonal to the length of the wearer's arm, as shown in FIG. 3*b*.

Additionally, in addition to serving to inhibit offensive attacks, such as punches, kicks, elbows, knees, blunt instrument attacks, taser deployments, throwing objects and projectiles, the shield member 12 may also be stab resistant from knives and other sharp, pointed objects. The standards for stab resistance are provided in the *Stab Resistance of Personal Body Armor* (*NIJ Standard*-0115.00), the disclosure of which is incorporated entirely herein by reference.

According to some embodiments, the securing mechanism 14 may be a catch mechanism, wherein the catch mechanism engages a portion of the shield member 12 and is secured to the attachment portion 16. In embodiments wherein the securing mechanism 14 is a catch mechanism, the activation mechanism 18 may be a pressure switch, wherein the pressure switch applies pressure to the catch mechanism, thereby releasing the catch devices and allowing the shield member 12 to move into the deployed position.

While it is contemplated that the securing mechanism 14 may be a catch mechanism or some other mechanical device, other types of securing devices are also contemplated. For example, and without limitation, the securing mechanism 14 may be an electro-mechanical device, wherein electronics operate a mechanical securing device. These electro-mechanical devices may be micro-electro-mechanical systems ("MEMS") wherein the activation switch is an electrical switch that communicates with the MEMS to operate the MEMS. Additionally, magnetic switches are also contemplated. In these embodiments, the magnets may be controllable field magnets, wherein the magnet field may be reduced to a strength wherein the spring constant and displacement of the spring produce a force greater than the force of the magnetic field, thereby allowing the shield member 12 to deploy.

The attachment portion 16 according to some embodiments may be a glove type design. For example, and not as a limitation, the attachment portion 16 as a glove may be composed of a lightweight breathable elastic material which stretches and conforms to the wearer's wrist and forearm. The glove may include a cutout for the thumb and wraps into the center of the palm. This configuration provides for the activation switch 18 to be coupled to the attachment portion 16 in a palm location, wherein the activation switch 18 can be easily accessed with the gross motor function of a tight clenching of the hand 20 into a fist. The glove will also be secured to the forearm with several fasteners 17. The fasteners 17 may be hook-and-loop fasteners, snap fasteners, belt fasteners, or other fastening mechanisms. In embodiments of the device 10, the attachment portion 16 may comprise material that is stab resistant from knives and other sharp pointed objects, such that the attachment portion 16 resists puncture impacts. The attachment portion 16 may further be comprised of ballistic-rated materials.

While shown to be a glove type design, the attachment portion 16 may also be simply a forearm attachment portion 16 or some other configuration that fits within the scope of this invention. For example, and not as a limitation, embodiments of the device 10 include the attachment portion 16 being comprised of an integral piece of ballistic-rated material, or may alternatively be comprised of a plurality of ballistic-rated materials incorporated into the lightweight breathable elastic material. Moreover, the attachment portion 16 may be adjustable, or custom fit, to the individual wearer, such that the attachment portion 16 resists movement with respect to the user's forearm under the condition that the attachment portion 16 and/or the shield member 12 receives an impact.

In use, the portable ballistic resistant shield device 10 is used by the wearer to protect the head, face, neck and upper body while leaving the hand free for personal weapon defense. Additionally, embodiments with the attachment portion 16 in a glove design, the hand with the device 10 is also free for grasping, striking, etc. In the deployed position, the device 10 may also be used as a weapon in defense or if offensive maneuvers are needed to disarm or detain an assailant. Further in the deployed position, in addition to the obvious physical advantages, the device 10 may also provide psychological benefits to the wearer over an assailant. For example, data have shown that when an individual is defending oneself from an assailant that is attempting to strike the individual with a projectile, if the individual places an object between the assailant and the individual such that the object is in the path between the assailant and the individual, the assailant will attempt to aim the projectile around the object in an attempt to circumvent the object, thus causing the assailant to aim wide of the individual, which in turn causes the projectile to miss the individual. Thus, once deployed, the device 10 not only establishes a physical barrier between the wearer and the assailant but also establishes a psychological obstacle in the mind of the assailant that impacts the behavior and efficacy of the assailant during the attack.

Figure 4A:
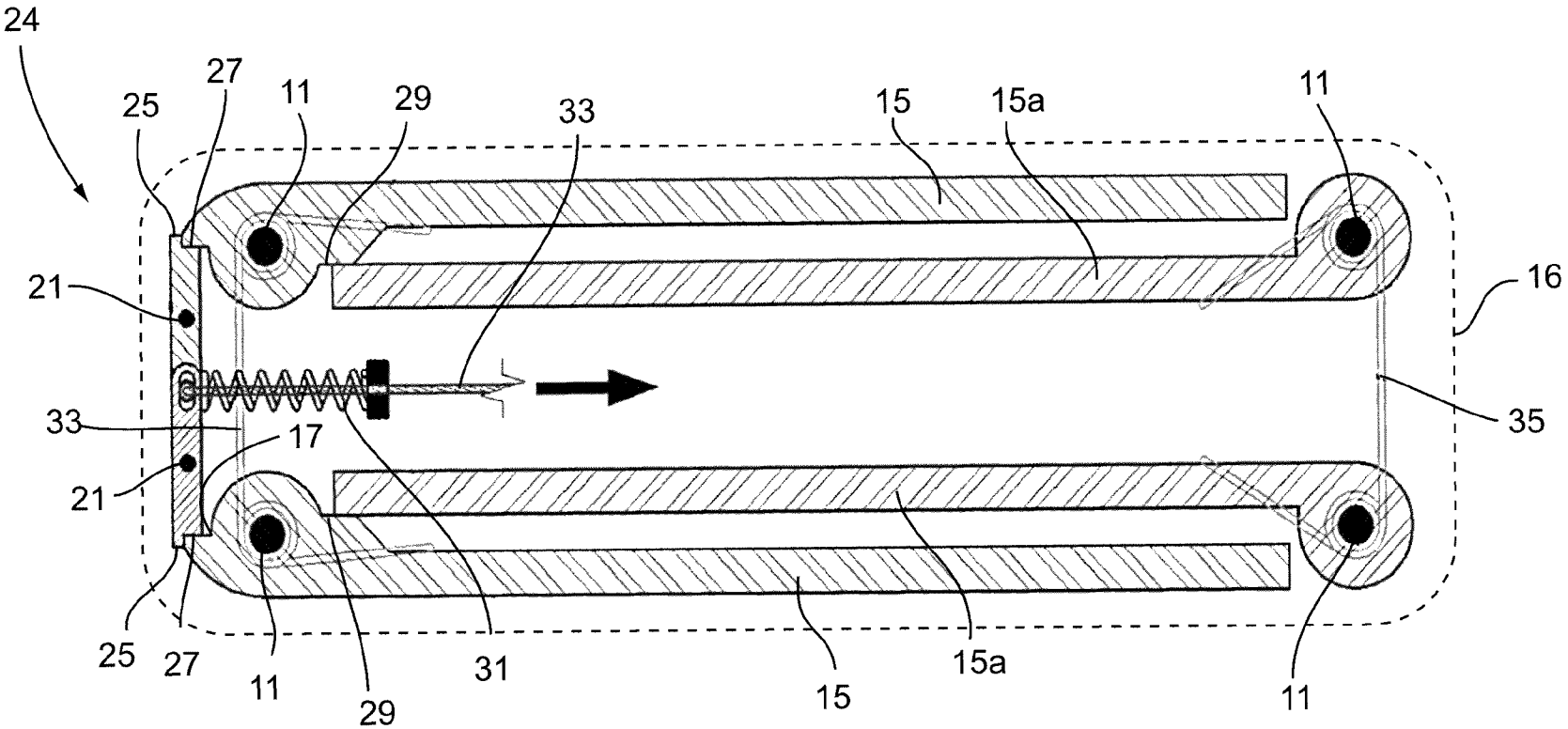
FIG. 4*a* is a perspective view of a portable ballistic resistant shield with a shield member in a stored position in accordance with the present disclosure.
Figure 4B:
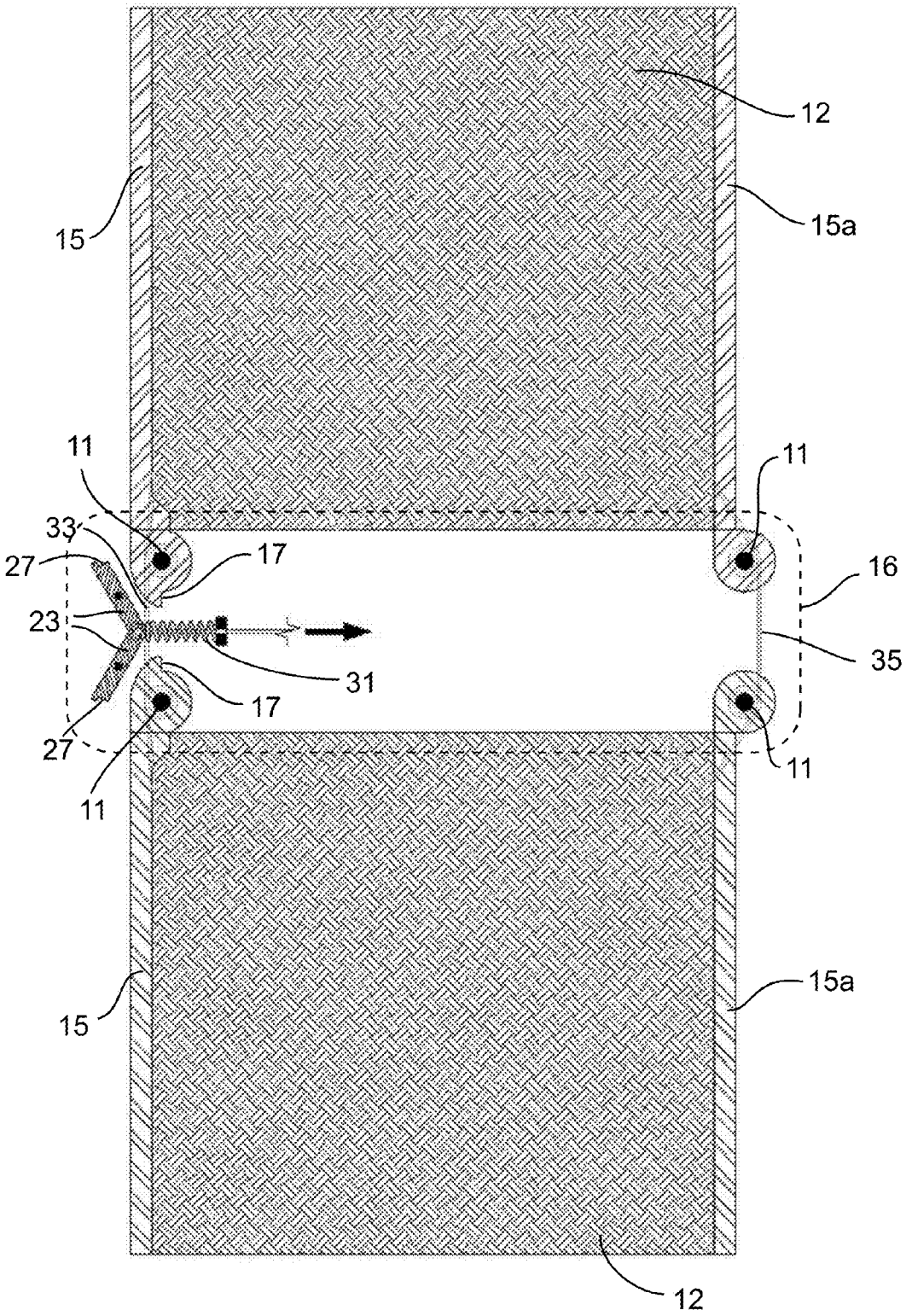
FIG. 4*b* is a perspective view of a portable ballistic resistant shield with a shield member in a deployed position in accordance with the present disclosure.

With reference to FIGS. 4*a*-4*b*, embodiments of the device 10 further comprise the attachment portion 16 for releasably and repeatedly coupling to the wearer of the device 10, and in particular to the forearm of the wearer, as herein described, the attachment portion 16 having a plurality of shield arms 15 that are configured to be deployed from the stored position to the deployed position upon the operation of the activation switch 18. The shield arms 15 may be configured to pivot about a pivot point 11 from a stored position on the attachment portion 16 to a deployed position, wherein at least a portion of the shield arms extend off of the attachment portion. The shield arms 15 may be configured to fold over one another in the stored position, a first shield arm 15 being configured to prevent a second shield arm 15*a* from deploying while in the stored position, as shown in FIG. 4*a*. For example, the first shield arms 15 may each be configured with a locking surface 29 near the pivot point 11, the locking surface 29 being configured to engage a surface of a respective second shield arm 15*a* to secure, and otherwise maintain, the second shield arm 15*a* in the stored position. Moreover, each of the first shield arms 15 may be configured with a mating face 17 near the pivot point 11, the mating face 17 and the locking surface 29 being oriented in the same direction but on opposing sides of the pivot point 11 about which the first shield arm pivots.

A securing mechanism 24 may be configured to secure the first shield arms 15 in the stored position. The securing mechanism 24 may comprise securing members 23 that may be configured to functionally communicate with one another and to pivot about their respective pivot points 21. In addition, the securing members 23 may have distal ends 25 thereon that functionally communicate with the first shield arms 15 to prevent the first shield arms 15 from deploying without activating the switch 18. For example, the distal ends 25 may be configured to have a notch 27 therein to communicate with a corresponding mating face 17 on each of the respective first shield arms 15. The notch 27 may function to engage the mating face 17 to prevent movement of the first shield arms 15 without activation of the switch 18. Each of the securing members 23 may have a coupling portion 19 that is configured to functionally couple to the switch 18, such that upon operation of the switch 18, the coupling portions 19 are engaged and the securing members 23 pivot about their respective pivot points 21 from a locked position to a released position. The pivoting action of the securing members 23 disengages the notch 27 from the mating face 17 and releases the first shield arms 15 from their stored position. Also, releasing the first shield arms 15 allows the engagement between the locking surface 29 and the second shield arms 15*a* to disengage and allow the second shield arms to deploy.

Embodiments of the device 10 further include a first shield arm biasing member 33 and a second shield arm biasing member 35. The first shield arm biasing member 33 may be configured to bias the first shield arms 15 in the deployed position, such that once deployed, the first shield arms 15 remain deployed. The biasing member 33 may be a torsion spring that is centered around and functionally held in place by each of the pivot points 11 about which the first shield arms 15 respectively rotate. In this way, the biasing member 33 can maintain the first shield arms 15 in the deployed position, as shown in FIG. 4*b*. Likewise, the second shield arm biasing member 35 may be configured to bias the second shield arms 15*a* in the deployed position, such that once deployed, the second shield arms 15*a* remain deployed. The biasing member 35 may be a torsion spring that is centered around each of the pivot points 11 about which the second shield arms 15*a* respectively rotate. In this way, the biasing member 35 can maintain the second shield arms 15*a* in the deployed position, as shown in FIG. 4*b*. Of course, each of the biasing members 33 and 35 may be compressed such that the first and second shield arms 15 and 15*a* can transition from the deployed position to the stored position, as shown in FIG. 4*a*. Of course, in the stored position, the biasing members 33 and 35 are compressed and held in their compressed state by the engagement between corresponding components of the securing members 23, the first shield arms 15, and the second shield arms 15*a*, as described herein. Once released, the biasing members 33 and 35 are strong enough to transition the shield arms 15 and 15*a* to their fully deployed position almost immediately, and yet are not so strong as to damage the arms 15 and 15*a* or the shield member 12 coupled between the arms 15 and 15*a*.

The pivot points 11 and 21 may be coupled directly to the attachment portion 16, thus allowing the first and second shield arms 15 and 15*a* to pivot, or otherwise move, with respect to the attachment portion 16 upon activation of the switch 18. Also, the securing members 23 may be biased toward the stored, or locked, position, as shown in FIG. 4*a*, to prevent the device 10 from inadvertently deploying without the wearer's intent. An activation biasing member 31 may be utilized to bias the securing members 23 in the stored position. The activation biasing member 31 may be a coil spring or other known spring-like device. The activation biasing member 31 may be coupled on one end to the attachment portion 16 to provide a secure base against which the activation biasing member 31 may be compressed upon operation of the switch 18. For example, a cord 33 may be coupled between each of the coupling portions 19 of the securing members 23 and the switch 18. Upon activation of the switch 18, the cord 33 may be pulled, or otherwise activated, to pull or move the securing members 23 against the activation biasing member 31 to compress the activation biasing member 31 against the attachment portion 16 to overcome the biasing force of the activation biasing member 31 that kept the device 10 in the stored position. Upon the condition that the force of the activation biasing member 31 is overcome, the securing members 23 pivot about their respective pivot points 21 and release the shield arms 15 and 15*a*, as described herein.

In this configuration, a flexible shield member 12 may be arranged between first and second shield arms 15 and 15*a* such that in the stored position the shield member 12 is stowed near the shield arms 15 and 15*a* near the attachment portion 16, so as to reside near the attachment portion 16 and not encumber the wearer. Additionally, the shield member 12 is further configured such that upon deployment of the shield arms 15 and 15*a*, as described above, the shield member 12 is deployed tautly therebetween, as shown in FIG. 4*b*. The flexible shield member 12 may be comprised of ballistic materials that bend or flex, such as for example, but not limited thereto, ballistic nylon, aramids like Kevlar®, polyethylene fibers like Dyneema® and Spectra®, and transparent ballistic material like ClearGuard® and TECDUR®.

The components defining any embodiment of a portable ballistic resistant shield device may be formed of any of many different types of materials or combinations thereof that can readily be formed into shaped objects provided that the components selected are consistent with the intended operation of a portable ballistic resistant shield device. For example, the components may be formed of: ballistic materials such as Kevlar, Boron, resistant plastics or other materials provided for in the Body Armor Standard Publications and *Stab Resistance of Personal Body Armor* (*NIT Standard*-0115.00); rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any embodiment of a portable ballistic resistant shield device may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

Another embodiment of the present invention includes a method of using a portable ballistic resistant shield device. The method includes the steps of coupling a portable ballistic resistant device to a forearm of a wearer; retaining a shield member of the device in a stored position; activating the activation switch of the device; actuating the securing mechanism in response to activating the activation switch; automatically moving the shield member from the stored position to a deployed position; and protecting the wearer from small arms fire, from knife attacks, and/or from hand-to-hand combat.

The method may also include steps of using the hand and fingers of the arm carrying the device; using the shield member in the deployed position as a weapon; and manually moving the shield member from the deployed position to the stored position.

The method may also include the steps of manually moving a portion of the shield member from the deployed position to the stored position while leaving another portion of the shield member in the deployed position.

Other method steps in the operation of the portable ballistic resistant shield device may be employed that includes the operation as described previously.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

What is claimed is:

1. A portable ballistic shield device, the device comprising:

an attachment portion for coupling the device to an arm of a user, wherein the attachment portion is configured to couple to the arm without restricting the function of the hand and fingers of the arm to which the device is coupled;

a shield member operatively coupled to the attachment portion, the shield member being configured to transition between a stored position and a deployed position;

a securing mechanism operatively coupled to the attachment portion, the securing mechanism being configured to maintain the shield member in the stored position; and an activation switch coupled to the attachment portion and operatively connected to the securing mechanism, wherein operation of the activation switch transitions the shield member from the stored position to the deployed position.

2. The device of claim 1, further comprising:

a biasing member coupled to the attachment portion, wherein the biasing member biases the shield member in the deployed position, such that under the condition the shield member is in the stored position and the activation switch is operated the shield member immediately transitions to the deployed position and remains in the deployed position.

3. The device of claim 1, wherein the activation switch is configured on the device to be operated by one of the arm, hand, fingers of the arm to which the device is coupled.

4. The device of claim 3, wherein the activation switch is located in the palm of the hand of the arm to which the device is coupled.

5. The device of claim 1, wherein the shield member is configured to occupy a larger surface area in the deployed position than in the stored position.

6. The device of claim 5, wherein the shield member is configured to pivot about a pivot point on the attachment portion between the stored and deployed positions.

7. The device of claim 5, wherein the shield member is configured to telescope with respect to the attachment portion between the stored and deployed positions.

8. The device of claim 1, wherein the shield member further comprises a shield arm and a plurality of shield parts, wherein neighboring shield parts are operatively coupled to one another, an outermost shield part is coupled to the shield arm, and the shield member is deployed as the shield arm moves with respect to the attachment portion.

9. A portable ballistic shield device, the device comprising:

an attachment portion for coupling the device to an arm of a user, wherein the attachment portion is configured to couple to the arm without restricting the function of the hand and fingers of the arm to which the device is coupled;

a plurality of shield arms operatively coupled to the attachment portion, each of the shield arms being configured to transition between a stored position and a deployed position;

a securing mechanism operatively coupled to the attachment portion, the securing mechanism being configured to maintain the plurality of shield arms in the stored position; and an activation switch operatively connected to the securing mechanism, wherein operation of the activation switch transitions the plurality of shield arms from the stored position to the deployed position.

10. The device of claim 9, further comprising:

a shield member coupled between the plurality of shield arms.

11. The device of claim 10, wherein the shield member is configured to occupy a larger surface area in the deployed position than in the stored position.

12. The device of claim 9, further comprising:

a plurality of pivots coupled to the attachment portion, each pivot being operatively coupled to a corresponding shield arm of the plurality of shield arms.

13. The device of claim 12, further comprising:

an activation biasing member operatively coupled between the securing mechanism and the activation switch; and a shield arm biasing member operatively coupled between the pivot and the corresponding shield arm, wherein the activation biasing member is configured to bias the plurality of shield arms in the stored position, and wherein each of the shield arm biasing members is configured to bias the shield arms in the deployed position.

14. The device of claim 9, the plurality of shield arms further comprising:

a pair of first shield arms; and a pair of second shield arms, wherein under the condition that the shield arms are in the stored position the pair of first shield arms function to maintain the pair of second shield arms in the stored position, and wherein under the condition that the activation switch is operated the pair of first shield arms transition from the stored position to the deployed position and release the pair of second shield arms to transition from the stored position to the deployed position.

15. The device of claim 14, wherein the securing member is configured to maintain the pair of first shield arms in the stored position until the activation switch is operated.

16. The device of claim 14, further comprising:

a first shield member operatively coupled between one of the first shield arms and one of the second shield arms; and a second shield member operatively coupled between a second of the first shield arms and a second of the second shield arms.

17. A method of using a portable ballistic device, the method comprising:

coupling a portable ballistic-resistant device to a forearm of a wearer;

retaining a shield member of the device in a stored position on the device;

operating an activation switch on the device;

automatically transitioning the shield member from the stored position to a deployed position in response to operating the activation switch, wherein in the deployed position the shield member occupies a larger surface area than the shield member occupies in the stored position; and using the deployed shield member to protect the wearer from small arms fire, from knife attacks, and/or from hand-to-hand combat.

18. The method of claim 17, further comprising:

using the hand and fingers of the arm carrying the device independently of the device;

using the shield member in the deployed position as a weapon; and manually moving the shield member from the deployed position to the stored position.

19. The method of claim 17, further comprising:

manually moving a portion of the shield member from the deployed position to the stored position while leaving another portion of the shield member in the deployed position.

* * * * *